United States Patent [19]

Walsh, Jr. et al.

[11] Patent Number: 4,983,215

[45] Date of Patent: Jan. 8, 1991

[54] NOVEL LIQUID METAL SEAL ON ZIRCONIUM OR HAFNIUM REDUCTION APPARATUS

[75] Inventors: Ronald E. Walsh, Jr., Corwallis; Te-Lin Yau; Peter T. Finden, both of Albany, all of Oreg.

[73] Assignee: Teledyne Industries, Inc., Albany, Oreg.

[21] Appl. No.: 406,976

[22] Filed: Sep. 13, 1989

[51] Int. Cl.[5] ..... C22G 54/00

[52] U.S. Cl. ..... 75/616; 75/617

[58] Field of Search ..... 75/84.4, 84.5, 616, 75/617

[56] References Cited

U.S. PATENT DOCUMENTS 4,637,831 1/1987 Stoltz et al. ..... 75/84.5

4,668,287 5/1987 Kwon ..... 75/84.5

*Primary Examiner*—Stephen J. Lechert, Jr.

*Attorney, Agent, or Firm*—Shoemaker and Mattare, Ltd.

[57] ABSTRACT

The present invention relates to the reduction of zirconium and hafnium tetrachloride by magnesium or sodium metal and, more particularly, to an improved reaction vessel design for the reduction reaction including a novel liquid metal seal.

1 Claim, 2 Drawing Sheets

NOVEL LIQUID METAL SEAL ON ZIRCONIUM OR HAFNIUM REDUCTION APPARATUS

BACKGROUND OF THE INVENTION

Zirconium or hafnium tetrachloride is reduced to zirconium or hafnium metal by reaction with a metal such as magnesium or sodium. The reaction is normally accomplished in a heated reduction vessel. This vessel is normally under an argon atmosphere and may become positively or negatively pressurized depending on the temperature changes which occur during the reduction reaction. The reaction chamber is protected from excessive increased or reduced pressure by a molten metal seal referred to as a molten metal vacuum pressure relief seal. Conventionally such a seal is designed to be an integral part of the lid. In conventional practice, a molten lead or lead alloy seal is provided. The use of lead and lead alloys has, however, created several operating problems with the reduction reactor. First, it is important that the seal not be frozen, i.e., to operate properly the lead or lead alloy should be molten. This might require supplemental heating of the metal used in the seal depending on the operating temperature of the reactor and the seal housing. Secondly, excessive negative pressure can draw liquid metal from the seal into the reaction vessel both breaking the seal to the atmosphere which could introduce unwanted air as well as contaminating the reaction mixture with molten lead or lead alloy. Lastly, waste disposal of used seal material becomes a problem since the lead and lead alloys used form a toxic waste producing special disposal problems. Background literature describing the prior practices provides further insights into the operation of such reaction vessels and the problems associated with liquid lead and lead alloy seals and the following references are incorporated by reference herein in their entirety.

REFERENCES

From these references, it will be seen that metals commonly used for these purposes include lead or lead alloys and customarily Pbll weight percent antimony.

However, lead and/or antimony dust from a seal are toxic and as such may constitute a health hazard for the operating personnel.

1. W. J. Kroll, A. W. Schlecten and L. A. Yerkes, Preprint 89-29, Pp 365-376, The Electrochemical Society, Apr. 15, 1946.

2. W. J. Kroll, A. W. Schlecten, W. R. Carmody, L. A. Yerkes, H. P. Holmes, and H. L. Gilbert. Preprint 92-16, Pp 187-201, The Electrochemical Society, Oct. 15, 1947.

3. W. J. Kroll, C. Travis Anderson, H. P. Holmes, L. A. Yerkes and H. L. Gilbert, Journal of the Electrochemical Society, Volume 94, No. 1, July 1948, Pp 1-20.

4. W. J. Kroll, and W. W. Stephens, Industrial and Engineering Chemistry, Vol. 42, Pp 395-398, Feb. 1950.

5. W. J. Kroll, W. F. Hergert, and L. A. Yerkes, J. Electrochemical Society, Vol. 97, No. 10, October 1950, Pp 305-310.

6. W. J. Kroll, W. W. Stephens, and H. P. Holmes, Transactions AIME, Vol. 188, December 1950, Journal of Metals, Pp 1445-1453.

Kroll and co-workers used a molten metal seal, a fusible alloy, on a vessel in conjunction with the reduction of purified zirconium chloride (1, 2). During operation of the furnace, excessive pressure could blow out through the molten metal seal and if the pressure was less than atmospheric pressure, helium was admitted through a valve in the side of the furnace. Metal and metal alloys used at different times were a bismuth-lead eutectic alloy (3), lead (4), lead alloy (5), and lead antimony (6). Lead antimony was substituted for the lead bismuth previously used because of a considerable savings in cost and upkeep, even though it had an inconvenient higher melting point and the inconvenience of shrinking on freezing. Industry practice has been to use the lead antimony eutectic, Pbll weight percent antimony, because it is inexpensive.

In practice, there are several problems associated with the use of this fusible metal as a molten metal seal in the reduction of zirconium or hafnium. Any escaping gases tend to form a dross, which consumes the metal. The alloy also reacts with air to form a dross, which consumes metal. The dross can contaminate the metal. When a molten metal seal is frozen, the metal shrinks. Occasionally the seal is incomplete and air leaks around the seal and contaminates the contents inside the reduction vessel, causing loss of value of the contents. Occasionally the alloy contaminates the products inside the reduction vessel because the molten metal is pushed into the vessel or because a weld on the molten seal container fails. Lead has a specification limit of 50 p.p.m. for zirconium used in United States naval nuclear reactors. This subsequently leads to lead metal and lead bearing wastes which are environmentally objectionable waste. Disposal of such a waste can be expensive. Excessive pressure inside the vessel can cause molten metal to splatter out of the seal and onto the surroundings. This is objectionable because of worker exposure to toxic lead/antimony and lead/antimony-bearing wastes. It is further objectionable because the solid waste is toxic environmentally and its disposal is difficult and expensive.

It is, therefore, an objective of the present invention to eliminate the use of lead and lead alloy seals on metal halide reduction reaction vessels.

It is a further objective to provide liquid metal seals that do not produce toxic waste products.

It is a still further objective of the present invention to provide a process for reducing metal halides to produce metal product without a risk of contamination by lead and lead alloys.

BRIEF SUMMARY OF THE INVENTION

It has been learned that combinations of bismuth and tin, and their alloys, can be advantageously utilized in a novel vacuum/pressure relief seal on a zirconium or hafnium metal reduction furnace thereby replacing a lead/lead alloy molten metal vacuum/pressure relief seal.

DETAILED DESCRIPTION OF THE INVENTION

Figure 1:
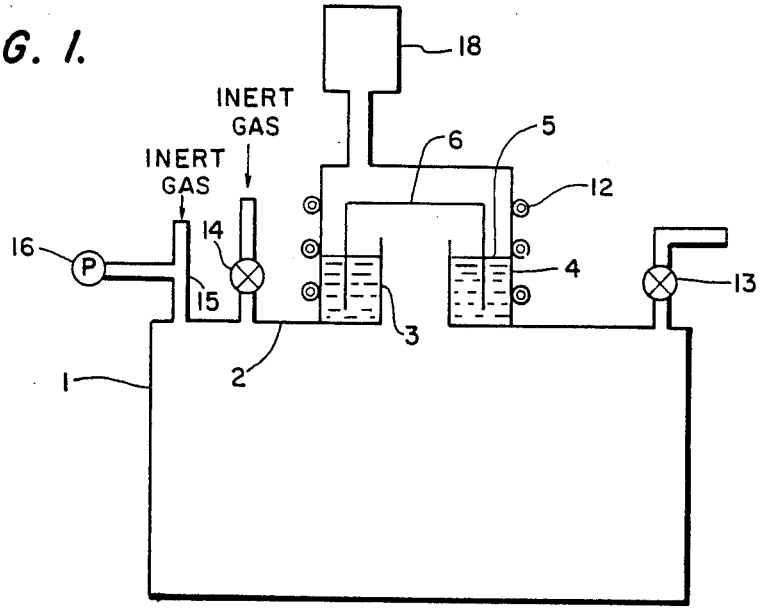
FIG. 1 is a schematic illustration of a liquid metal seal as employed on a metal halide reduction furnace.

Referring to FIG. 1, a reactor vessel 1 has an open pipe 3 rising out of reactor vessel lid 2 and communicating with the interior of the reduction reaction vessel 1. Another pipe 4, having a larger diameter than pipe 3 and extending vertically above the upper termination of the open end of pipe 3 is connected, in an air-tight manner, to reactor lid 2 such that the space between pipes 3 and 4 can be filled with a liquid metal 5. Another pipe 6, capped on its upper end, is placed between pipes 3 and 4 with its lower end submerged in molten metal 5. Liquid metal is introduced into the annular chamber formed by pipe 3, pipe 4 and reactor lid 2, pipe 6 is sized so that it will float in the liquid metal 5. Reactor vessel 1 encloses materials (not shown) to be protected against the entry of ambient air from the atmosphere outside vessel 1 which could react therewith. The dimensions of pipes 3, 4 and 6, depend upon the range of pressures, both positive and negative, compared to atmosphere pressure outside the vessel, that is predetermined to be used inside of the reactor vessel, taking into account the density and weight of the molten metal to be used, and the density of the metal float 6. A heater 12 supplies heat to maintain the liquid metal 5 in liquid form. Pipes 3, 4 and 6 are preferably round pipe, but other shapes can be used.

Figure 2A:
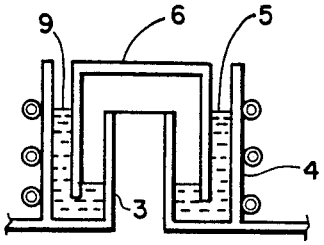
FIGS. 2*a*, 2*b*, 2*c*, and 2*d* are schematic illustrations of the liquid metal seal of the present invention in operation.
Figure 2B:
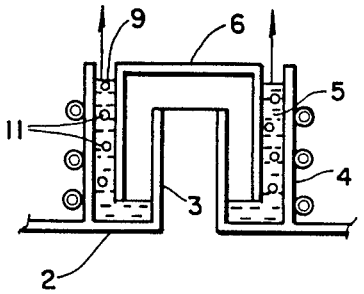
Figure 2C:
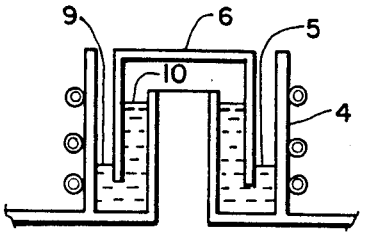

The seal generally operates within a pressure range which neither releases gaseous material from inside the vessel through the seal to the surrounding atmosphere (see FIG. 2*a*) nor draws air surrounding the vessel through the seal into the vessel (see FIG. 2*c*). To maintain normal pressures the vessel is generally operated to bleed over-pressure gaseous materials through a vent valve 13 into a system (not shown) and in a manner not shown to capture the bleed in a manner such that it can be recovered and recycled and not contaminate the surrounding environment and or personnel. Further, the vessel is generally operated to add an inert gas into the reactor through a valve 14 in the event the pressure goes below a predetermined value in the normal pressure operating range. The pressure inside the vessel is normally measured by a differential pressure gage 16, which may be used in a conventional manner to control both bleed or vent operations and the over-pressure of inert gas as described. Atmospheric pressure is maintained inside pipe 4 and over float 6 by means of a vent or collection arrangement, not shown, at 18.

Figure 2D:
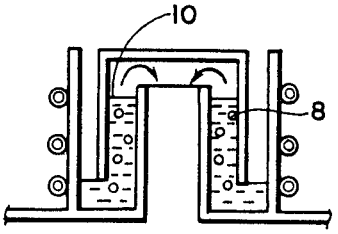

The molten seal protects the vessel against above normal pressure by relieving excessive pressure through the molten metal seal as liquid level 10 of molten metal 5 drops below the bottom of pipe 6 which allows bubbles 11 of the gas from inside the reactor to rise through molten metal 5 and mix with ambient air (FIG. 2*b*). Generally the gas leads through a pipe communicating with the interior of pipe 4 to the vent or collection system 18 (not shown, generally piping to a water or caustic scrubber) which prevent contamination of the atmosphere. Above normal pressures are generally avoided by the control described herein. In this regard, the molten metal seal protects the vessel against below normal pressure by allowing ambient air to bubble up through the molten metal and into the reactor vessel 1 as level 9 of metal 5 drops below the bottom of pipe 6 (FIG. 2*d*). Below normal pressures are generally not expected and constitute an emergency condition since contamination of the reaction vessel contents can occur.

The metals commonly employed in liquid metal seals are lead or lead alloys, and frequently lead antimony alloys are employed.

Some lead from present lead and lead alloys molten metal vacuum/pressure relief seals on zirconium and hafnium halide reduction furnaces ends up in sludge classifying the sludge a toxic waste. Proper disposal of toxic wastes is expensive and can constitute a potential long term liability to the producer of the waste. Lead dust can be created when using lead and lead alloy seals which dust is toxic and may constitute a health hazard for operating personnel unless special precautions are used. As previously described, lead and lead alloy materials may leak in&.o a reduction furnace and contaminate the material, whereby valuable product may be lost, and further toxic waste material may be generated.

It has been determined that bismuth/bismuth alloys including bismuth-tin alloys and tin/tin alloys including tin-bismuth alloys provide superior liquid metal seals for metal halide reduction furnaces and, more particularly, as a liquid metal seal in reduction furnaces for reacting zirconium chlorides or hafnium chlorides with magnesium or sodium to produce zirconium or hafnium metal.

It has been found that a suitable metal for use as a liquid seal in a vacuum pressure apparatus is tin bismuth, tin or an alloy of bismuth and tin whose physical properties include melting at a temperature range from about 139° C. to about 232° C. and which exhibits no change in volume or a negative volume change upon solidification inside of said reaction vessel for the control of an inert gas atmosphere, such as argon, helium and others, in said vessel within predetermined limits. These include a range of from about +5 p.s.i.g. to about −5 p.s.i.g. and preferably at from about +3 p.s.i.g. to about −3 p.s.i.g., the values selected to maintain the liquid seal in the containing means or apparatus. It was also found that other suitable material for the metal seal can be used providing a range of liquidity of from about 139° C. to about 550° C. and preferably at about 400° C. where it also exhibits, upon solidification, a positive change, no change or negative change in volume.

These alloys are particularly advantageous where bismuth is present in sufficient amounts to provide for an expansion when the alloy solidifies. This property enables the seal to hold a vacuum or pressure before the metal has melted or when it solidifies on cooling. Air leakage is, therefore, greatly reduced or eliminated in the operation of the reaction vessel. In addition, bismuth and bismuth alloys and tin and tin alloys, if carried into the interior of the reaction vessel, do not objectionably degrade the quality of the zirconium or hafnium metal produced. Bismuth has a low thermal neutron capture cross-section (0.032 barns) compared to lead (0.17 barns) and tin compares favorably to PbllSb. Further, bismuth and tin and their alloys are not anymore reactive to air than lead and are not considered to be very reactive with the metal halides at the temperatures (about 400° C.) employed in the reduction reactor.

Figure 3:
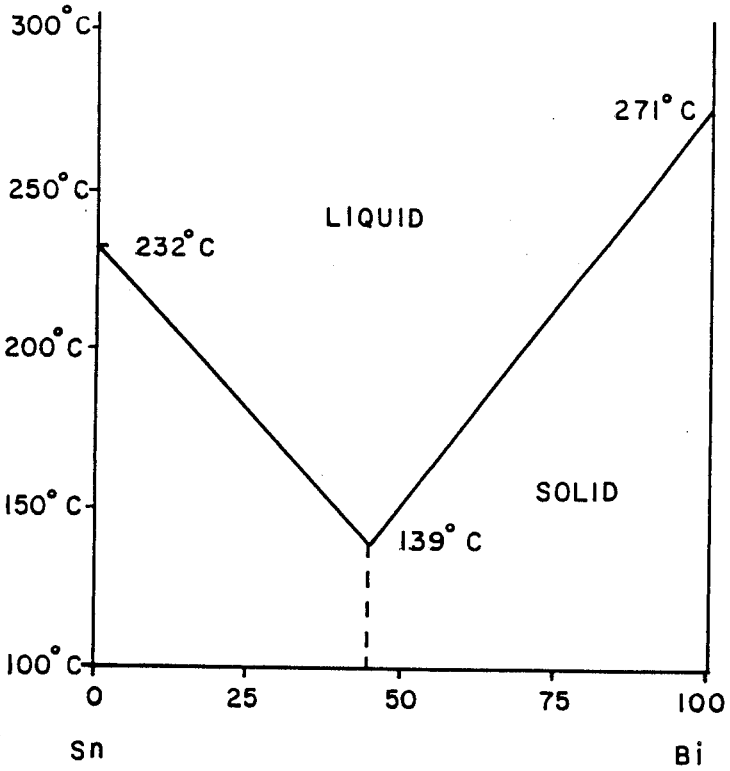
FIG. 3 is a phase diagram of atomic percentage of bismuth-tin alloys useful in the liquid metal seal of the present invention.

Further, the alloys contemplated for use herein, which include substantially all possible bismuth-tin combinations shown in FIG. 3, have suitable melting points for use in the seal described, requiring simply a taller structure to accommodate the difference in densities compared to lead.

Finally, the toxicity of the bismuth and tin alloys contemplated is low so as to reduce the potential of hazard to both personnel and the environment, and the alloys, according to this invention, can be selected to be contained in either mild steel, cast iron, or previously blued mild steel.

The following Examples show experiments with the materials to be used in the practice of the present invention.

In the case of zirconium, lead and lead alloys can contribute to the thermal neutron capture cross section of the material as used in alloys in structural components in nuclear reactors.

EXAMPLE 1

Tin metal was placed in a ceramic boat and exposed to approximately 410° C. zirconium tetrachloride flowing across it for 2 hours. The weight increase of metal during this period was about 0.002%. The metal appeared clean. It was concluded that tin and zirconium tetrachloride were not reactive.

EXAMPLE 2

Bismuth metal was placed in a nickel metal boat and exposed to hot (383°–432° C.) zirconium tetrachloride for 2 hours. The weight change of bismuth metal was an increase of about 0.06%. A small amount of white residue was noticed on the surface, that was somewhat sticky. The rest of the metal appeared clean. It was concluded that: bismuth and zirconium tetrachloride were not reactive or minimally reactive.

The invention described is equally applicable to seal rotating shafts which can protrude through the lid of a reaction vessel, such as the apparatus described in U.S. Pat. No. 4,668,287, issued May 26, 1987, and in any apparatus where the contents of the reaction vessel need to be protected from reacting with air.

The present invention contemplates the use of a wide variety of possible alloy combinations which can be selected for a particular application without undue experimentation or independent invention. The inventive concept as applied to the variety of embodiments possible is, therefore, only limited by the scope of the appended claims interpreted in view of the applicable prior art.

It will be understood by those skilled in the art that the present invention also contemplates the reduction reaction by magnesium or sodium with niobium, tantalum or vanadium chloride to their respective metals involving vessels as described having metal seals. It is also understood that the present invention is useful in the electrochemical preparation of hafnium, zirconium, titanium, niobium, tantalum and vanadium metals where their respective chlorides are electrochemically reduced in the presence of molten salts. In other environments where protection from the air is necessary, such as in seals for rotating shafts as disclosed in U.S. Pat. 4,668,287 issued May 26, 1987, where a rotating shaft is connected to an agitator in a molten salt bath, the present invention can be used through the vessel's lid. Still other uses will become apparent upon a thorough reading of the disclosure examples and claims of this invention.

We claim:

1. A method of reducing metal halides in a sealed reaction vessel comprising the steps of (a) introducing a reducing metal into a reaction vessel;

(b) introducing a metal halide to be reduced into said reaction vessel;

(c) providing an inert gas atmosphere in said reaction vessel;

(d) heating the contents of said reaction vessel to a sufficient temperature for a sufficient period of time for said reducing metal to reduce said metal halide to free metal;

(e) maintaining said inert atmosphere in said reaction vessel isolated from the atmosphere by means of a heated liquid metal seal comprising alloys selected from the group consisting of bismuth and metals of bismuth including tin alloys.

* * * * *